US005719824A

United States Patent [19]

Boucher

[11] Patent Number: 5,719,824

[45] Date of Patent: Feb. 17, 1998

[54] TRANSDUCER ASSEMBLY WITH ACOUSTIC DAMPING

[75] Inventor: Stephen G. Boucher, Amherst, N.H.

[73] Assignee: Airmar Technology Corp., Milford, N.H.

[21] Appl. No.: 646,050

[22] Filed: May 7, 1996

[51] Int. Cl.[6] ..... H04R 17/00

[52] U.S. Cl. ..... 367/176; 367/162; 310/326; 310/337

[58] Field of Search ..... 367/162, 176; 310/334, 337, 327, 326

[56] References Cited

U.S. PATENT DOCUMENTS

| | | | |
|---|---|---|---|
| 4,004,266 | 1/1977 | Cook et al. | 367/162 |
| 4,110,727 | 8/1978 | Kriege | 340/10 |
| 4,644,787 | 2/1987 | Boucher et al. | 73/187 |
| 4,644,788 | 2/1987 | Boucher | 73/187 |
| 5,038,067 | 8/1991 | Tabin | 310/334 |
| 5,313,834 | 5/1994 | Lagace | 73/290 |
| 5,339,292 | 8/1994 | Brown et al. | 367/176 |
| 5,581,025 | 12/1996 | Boucher et al. | 73/187 |

FOREIGN PATENT DOCUMENTS

| | | |
|---|---|---|
| 62-294921 | 12/1987 | Japan . |
| 01 109897 | 4/1989 | Japan . |
| 2 260 059 | 3/1993 | United Kingdom . |

*Primary Examiner*—Ian J. Lobo

*Attorney, Agent, or Firm*—Hamilton, Brook, Smith & Reynolds, P.C.

[57] ABSTRACT

An ultrasonic transducer assembly for generating and receiving ultrasonic vibrating forces comprises an ultrasonic transducer and a unitary housing for mounting to a marine vessel. The housing has a cavity formed therein for disposing the ultrasonic transducer. An acoustic window portion transmissive to the sonic vibrating forces is formed in the bottom of the housing. The ultrasonic transducer includes a transducer element having a cork layer on its sides and inner foam layer on its top surface. A potting material such as urethane encapsulates the ultrasonic transducer in the cavity. A portion of the potting material forms a potting layer between the bottom surface of the transducer element and the acoustic window portion of the housing. The ultrasonic transducer includes an electrostatic shielding enclosure which surrounds the top and sides of the transducer element and has an outer foam layer on its outer surface to impede and attenuate unwanted transmission of ultrasonic pressure waves toward the transducer element.

35 Claims, 4 Drawing Sheets

TRANSDUCER ASSEMBLY WITH ACOUSTIC DAMPING

BACKGROUND OF THE INVENTION

This invention relates to marine instruments and in particular to transducers for generating a beam of acoustic energy for use in sonar devices.

Many echosounder systems include a copper or other electrically conductive material forming an electrostatic shield about a piezoelectric transducer in a transducer housing. The piezoelectric transducer, upon being provided with an appropriate alternating electrical signal, produces a mechanical vibratory signal which is transmitted into the water. Upon return of this signal, the transducer converts the mechanical vibratory signal into a corresponding electrical signal, which may be processed and displayed on an appropriate display on the boat.

A recurring problem with echosounders is that as boat speed increases, turbulence is created which causes noise to appear on the display. In through-hull mounted systems, the turbulence is due to vortices which are shed from the aft surfaces of the transducer housing. The vortices create pressure waves which impinge on the transducer housing. In transom mounted systems, the pressure waves are caused by buffeting and general turbulent flow around the bow of the transducer housing. In either type of system, the pressure waves are transmitted through the transducer housing to the piezoelectric element. These waves excite the piezoelectric element, generating electrical impulses which are received and processed by the echosounder. Some of these waves are not filtered out and subsequently are presented on the display. Since these are randomly distributed and unwanted, they are generally referred to as noise, or more precisely as flow noise. The higher the boat speed, the greater the amount of flow noise; eventually the display is filled with noise which masks target echoes.

Approaches to solving this problem include raising the acoustic output power of the transducer, thereby raising the signal-to-noise ratio, and making the transducer housing more streamlined, thereby generating less turbulence.

A first approach has been pursued with the output power of echosounders increasing year by year as power semiconductors decrease in cost. However, this approach is limited by cavitation. Likewise, increasing the active surface of the piezoelectric material to increase the output power adds undesirable size and cost to the echosounder. Regarding a second approach, transducer housings can be made more streamlined by increasing the length to width ratio. However, this results in a very long housing which is both expensive to construct and difficult to install. A third approach is to attenuate the pressure waves that reach the piezoelectric element using any of several techniques, including using passive damping materials to absorb pressure wave energy and surrounding all but the active surface of the piezoelectric element with air (referred to as an "air-backed" element) to isolate the piezoelectric element from the pressure waves.

SUMMARY OF THE INVENTION

An objective of the invention is to increase the high speed performance of through-hull and transom mounted piezoelectric transducers. A transducer assembly that is a novel and improved way of attenuating pressure waves transmitted to the piezoelectric element has been found to provide superior flow noise performance.

The present invention provides multiple reflective interfaces used in conjunction with viscoelastomeric absorbing materials to greatly attenuate and reflect pressure waves generated by high-speed water flow over a transducer housing. The novel transducer assembly includes conventional transducer attenuation and isolation materials in an arrangement having material interfaces that are not commonly found in transducer construction.

Accordingly, an ultrasonic transducer assembly for generating and receiving ultrasonic vibrating forces comprises a unitary housing for mounting to a marine vessel and an ultrasonic transducer. The housing has a cavity formed therein for disposing the ultrasonic transducer. The ultrasonic transducer includes a transducer element having a first isolation layer on its sides and a second isolation layer on its top surface. The ultrasonic transducer includes an electrostatic shielding enclosure which surrounds the top and sides of the transducer element and has a third isolation layer on its outer surface to impede and attenuate unwanted transmission of ultrasonic pressure waves toward the transducer element. The first isolation layer is preferably made of cork. The second and third isolation layers are preferably made of a foam material, such as neoprene. Preferably, an acoustic window portion transmissive to the ultrasonic vibrating forces is integrally formed in the bottom of the housing.

A potting material, such as urethane, encapsulates the ultrasonic transducer in the cavity. A portion of the potting material forms a potting layer between the bottom surface of the transducer element and the acoustic window portion of the housing. The housing is preferably plastic with the acoustic window portion having a thickness of about ¼ of the wavelength of sound in plastic at an operating frequency of the transducer.

BRIEF DESCRIPTION OF THE DRAWINGS

The above and other features of the invention including various novel details of construction and combinations of parts will now be more particularly described with reference to the accompanying drawings and pointed out in the claims. It will be understood that the particular transducer assembly embodying the invention is shown by way of illustration only and not as a limitation of the invention. The principles and features of this invention may be employed in varied and numerous embodiments without departing from the scope of the invention.

DETAILED DESCRIPTION OF PREFERRED EMBODIMENTS

Figure 1:
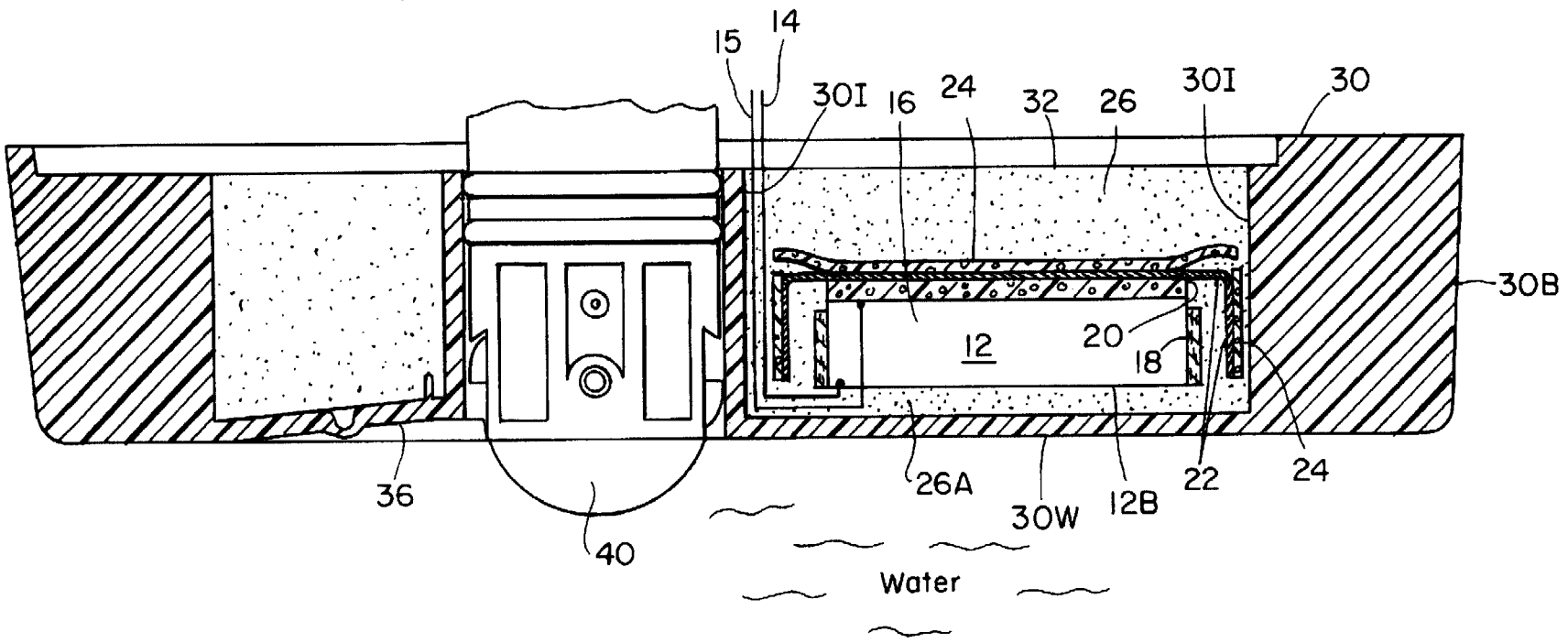
FIG. 1 is a partial sectional view of an assembly of the present invention.
Figure 2:
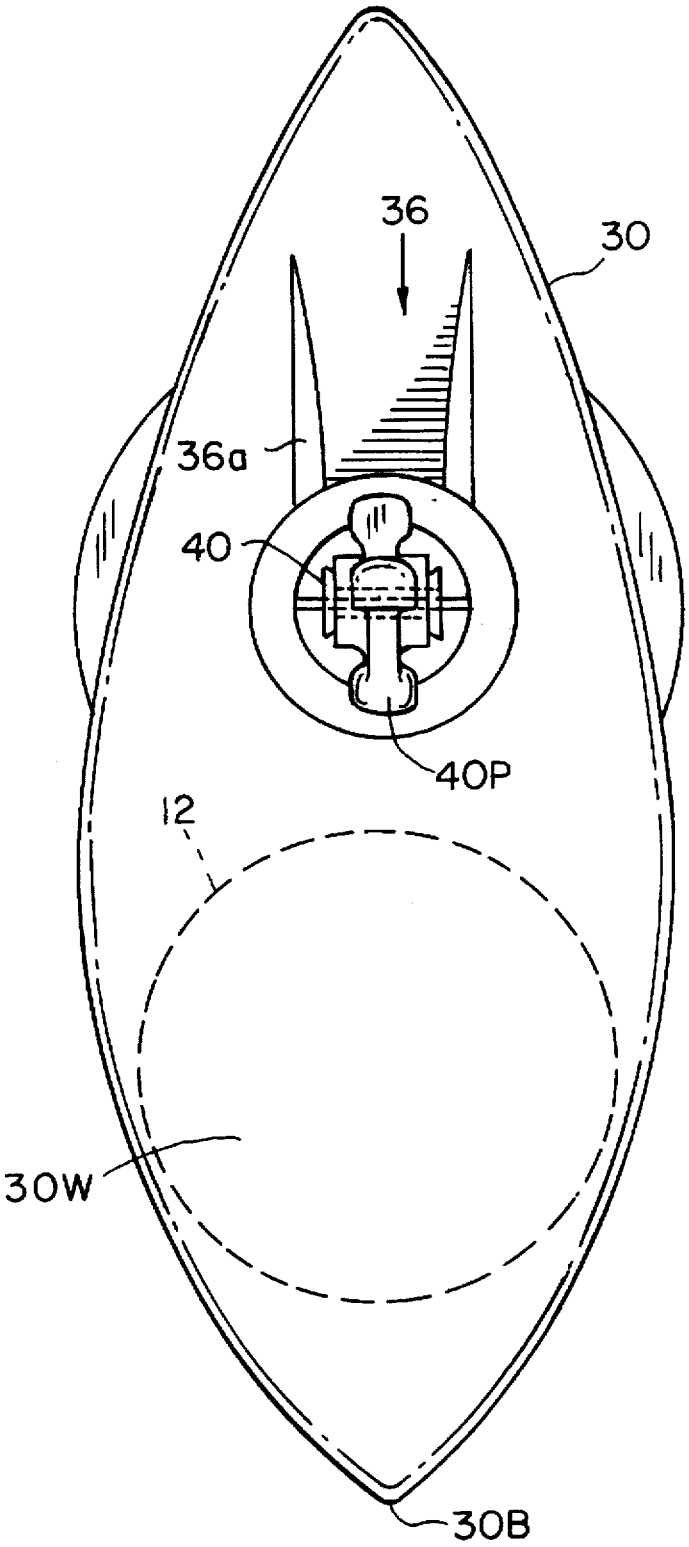
FIG. 2 is a bottom view of the assembly of FIG. 1 showing the window portion 30W in the bottom of the housing 30.

Referring now to FIGS. 1 and 2, an ultrasonic transducer 12 is shown mounted within a housing 30. Ultrasonic transducer 12 comprises an electrostatic shielding can or enclosure 22 formed from drawn aluminum, or other suitable material, disposed about a piezoelectric transducer element 16. Inner foam layer 20 and cork layer 18 enclose generally cylindrical piezoelectric transducer element 16 at the top and sides, respectively. The transducer 12 is disposed within a cavity 32 formed by inner walls 30I in a bow portion 30B of housing 30. An acoustic window portion 30W is integrally formed in the bottom of the housing 30.

Electrical leads 14 and 15 are provided in electrical contact with the bottom and top, respectively, of piezoelectric transducer element 16. Outer foam layer 24 encloses shielding can 22 at the top and sides.

The inner and outer foam layers 20, 24 are preferably made of closed cell neoprene. The cork layer 18 is preferably made of Corprene® material, a neoprene impregnated cork material available from Armstrong. The cork and foam materials 18, 20 enclosing the piezoelectric transducer element 16 provide a barrier against unwanted transmission of ultrasonic pressure waves from the top and sides of housing 30. It should be noted that the cork and foam materials 18, 20 can be reversed such that the cork layer is on the top and the foam is on the sides of the transducer element 16. Other suitable materials can also be used to attenuate sound energy and isolate the transducer element, such as silicone foams.

The inner portion of housing 30 is encapsulated in a viscoelastomeric potting material 26, preferably urethane, to ensure water-tight encapsulation and at the same time, provide a path for the energy from piezoelectric transducer element 16 to travel unimpeded out through the bottom of housing 30. A portion of the potting material 26 forms a transmissive potting layer **26*a* between the bottom surface 12B of the transducer element 16 and acoustic window portion 30W. The potting layer 26*a* has a thickness in the range of 1 mm to 25 mm, and is preferably about 3 mm. The potting material 26 encapsulates the transducer element 16 in the cavity 32 such that the element will not enter a mechanical resonance induced by fluid flow around the housing 30. This type of resonance was observed during field tests of prior art air-backed ultrasonic transducer assemblies and is eliminated by substituting viscoelastomeric potting material 26 for air around the cork layer 18**.

Piezoelectric transducer element 16 may comprise well-known lead zirconate titanate material, barium titanate or other equivalent material. The housing 30 is made of an easily formed material, preferably a non-foam thermoplastic material, such as polycarbonate or ABS alloy. In the preferred embodiment, housing 30 includes an exit flow channel 36 substantially as described in U.S. Pat. No. 5,581,024 filed Feb. 12, 1996 which is incorporated herein by reference in its entirety. A through-hull speed sensor assembly 40 of the paddlewheel type is mounted in an intermediate portion of housing 30 also substantially as described therein.

There are tradeoffs in the choice of materials involving cost, strength, acoustic impedance and damping characteristics. Using a metal housing instead of plastic, for example, results in a much more reflective interface, but metal housings are costly and have other limitations.

Conventional echosounder systems employ transducers which have an acoustic opening or window comprising urethane potting material for optimal transmission of ultrasonic pressure waves from the transducer element to the water surface below the housing. These echosounder transducers are relatively expensive to manufacture because special jigs and fixtures are required to seal the opening when potting material is dispensed into the housing. Other techniques for sealing the opening require machining at a later stage of manufacturing.

The preferred embodiment of the present invention uses a quarter wavelength plastic acoustic window 30W between the urethane potting layer **26*a* and the water below the housing 30. The quarter wavelength refers to one quarter of the wavelength of sound in plastic at a particular operating frequency. While the quarter wavelength thickness of the window 30W** is preferred, other thicknesses will provide good results. A gradual erosion in performance occurs as the acoustic window thickness increases beyond the quarter wavelength thickness.

The acoustic response of the preferred embodiment provides comparable performance to a construction where the acoustic window is a single material such as urethane. Conventional acoustic theory suggests that for good performance a quarter wavelength matching layer should have an acoustic impedance between that of the two adjacent materials. The acoustic impedance or characteristic impedance of a medium is equal to $\rho_o c$ where $\rho_o$ is the density of the medium and c is the speed of sound in the medium. This applies in the case of plane waves. The MKS unit of specific acoustic impedance is Pa·s/m or more commonly is expressed in rayls or Megarayls. In the present invention, the acoustic impedance of the plastic window 30W is higher than the two adjacent materials, urethane and water. The unexpected positive performance results of the preferred embodiment are attributed to the fact that a quarter wavelength of plastic is a true matching layer that offsets the losses of transitioning from a relatively low acoustic impedance (urethane: 1.7 Megarayls) to a higher acoustic impedance (plastic: 2.8 Megarayls) and back to low acoustic impedance (water: 1.5 Megarayls). Another reason for the positive results of the preferred embodiment is that the plastic acoustic window 30W has a smoother, polished surface which generates less flow noise than a urethane window in turbulent flow.

Figure 3:
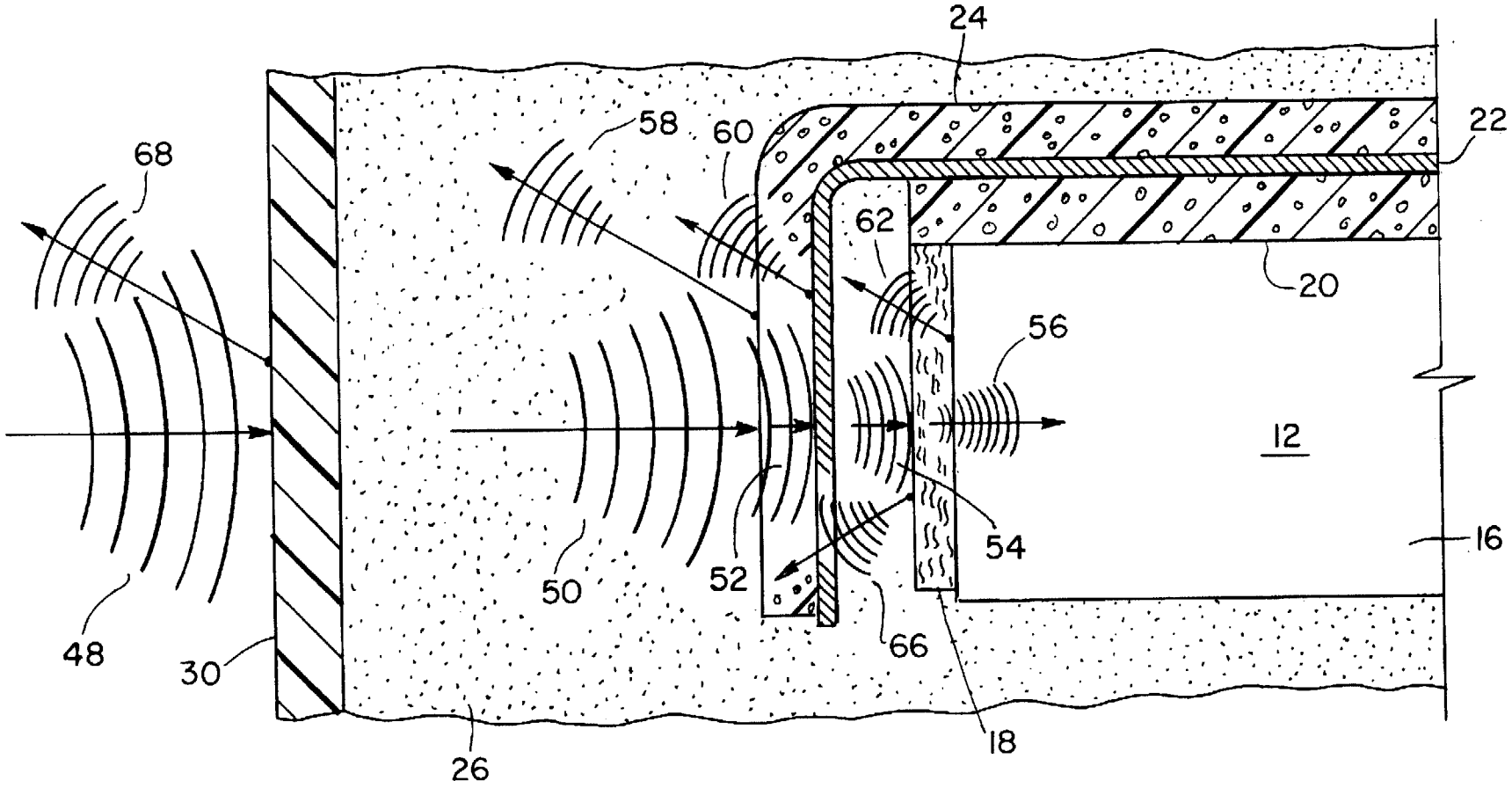
FIG. 3 is a partial view of the assembly of FIG. 1 illustrating the acoustic path of ultrasonic pressure waves.

As noted above, the materials employed in the transducer provide a barrier against unwanted transmission of ultrasonic pressure waves from the top and sides of housing 30. Referring to FIG. 3, the acoustic path of pressure waves from the housing 30 to the piezoelectric transducer element 16 is shown.

The material interfaces provide acoustic impedance mismatches. At each interface, some of the energy is reflected and some is transmitted. An ultrasonic pressure wave 48 that is transmitted through the water impinges on housing 30. A portion 68 is reflected from the housing 30. Another portion 50 is transmitted through the housing 30 and attenuated by potting material 26. Wave 50 is further reflected at the urethane 26/foam 24 interface as portion 58 and attenuated as portion 52. At the foam 24/aluminum 22 interface, a portion 60 is reflected and a portion 54 is transmitted through to the urethane 26. At the urethane 26/Corprene® 18 interface, a portion 66 is reflected. Finally, a portion 56 at a much attenuated level reaches the piezoelectric element 16. At the element 16, a portion 62 is also reflected.

Figure 4:
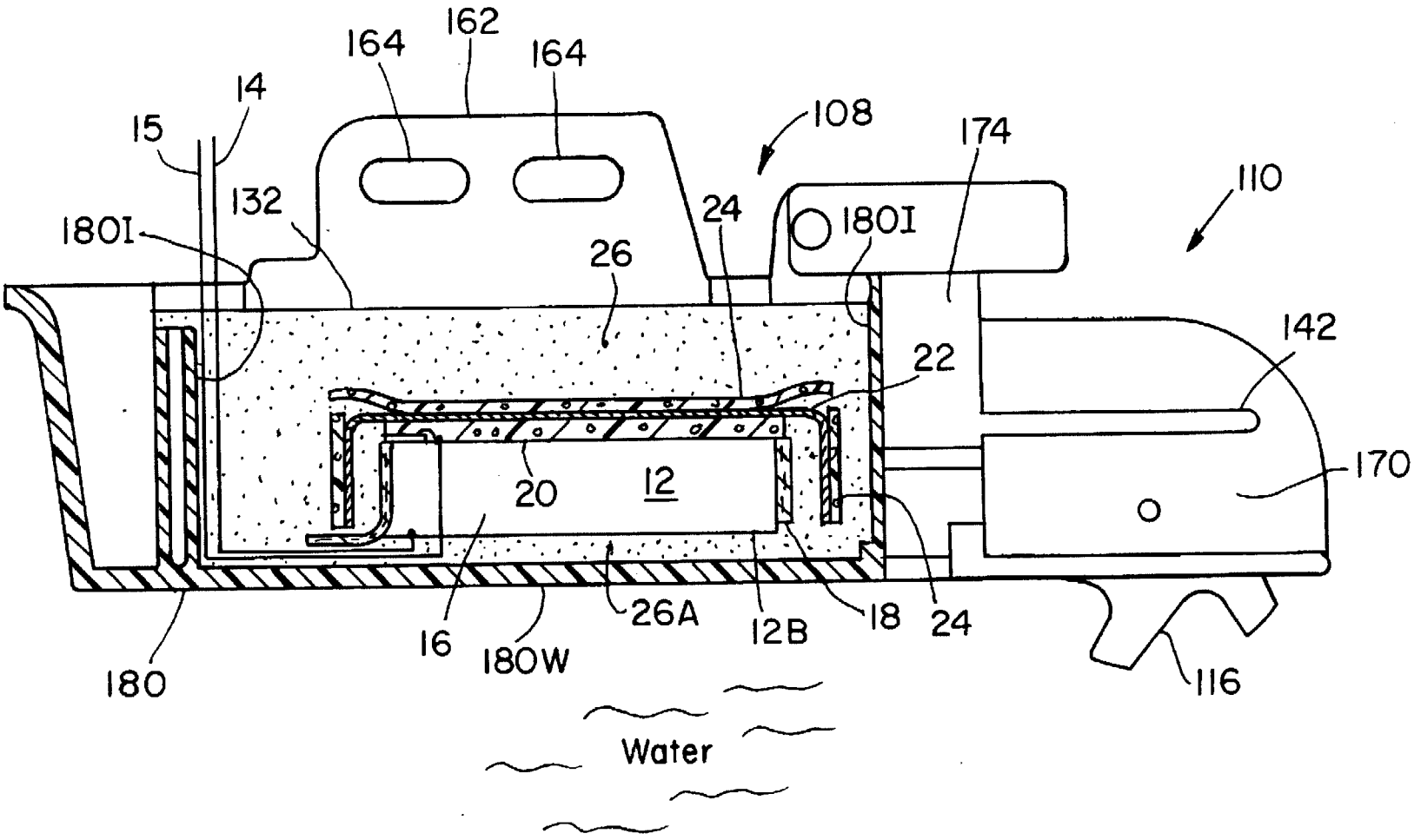
FIG. 4 is a sectional view of a second embodiment of the present invention.

Referring now to FIG. 4, a second embodiment of an ultrasonic transducer assembly suitable for transom mounting is shown. The assembly may be seen to comprise, in general, two subassemblies, a sensor subassembly, shown generally at arrow 108, and a rotatable paddlewheel subassembly, shown generally at arrow 110.

The assembly is of the transom mount type disclosed in U.S. Pat. No. 4,644,788 incorporated herein by reference in its entirety. The paddlewheel subassembly 110 comprises paddlewheel 116 rotatably mounted between a pair of struts 170 attached to a frame 174. Bracket members 162 are provided with apertures 164, to which mounting brackets (not shown) may be secured for mounting the housing 180 onto the transom.

Sensor housing 180 includes a cavity 132 formed by inner walls 180I within which is disposed ultrasonic transducer 12. The ultrasonic transducer 12 is as described above for the embodiment of FIGS. 1 and 2. An acoustic window portion 180W is integrally formed in the bottom of housing 180 which serves the same function as the window portion 30W disclosed above.

The second embodiment of FIG. 4 operates similar to the first embodiment with respect to the attenuation and reflection of pressure waves transmitted to the piezoelectric transducer element 16 to provide improved performance in the flow regime of transom mount housings.

Equivalents

While this invention has been particularly shown and described with references to preferred embodiments thereof, it will be understood by those skilled in the art that various changes in form and details may be made therein without departing from the spirit and scope of the invention as defined by the appended claims. For example, the scope of the invention includes embodiments wherein the transducer element operates at sonic rather than ultrasonic frequencies. In such embodiments, the interface materials are selected to optimize performance at sonic frequencies.

What is claimed is:

1. An ultrasonic transducer assembly for generating and receiving ultrasonic vibratory forces comprising:

a unitary housing for mounting to a marine vessel, including a cavity formed therein for disposing an ultrasonic transducer;

an ultrasonic transducer disposed in the cavity comprising a transducer element having a first isolation layer on its sides and a second isolation layer on its top surface, an electrostatic shielding enclosure surrounding the top and sides of the transducer element having a third isolation layer on its outer surface; and a layer of potting material formed between the bottom surface of the transducer element and the bottom of the housing.

2. The assembly of claim 1 wherein the housing is formed of plastic.

3. The assembly of claim 1 wherein the potting material is urethane.

4. The assembly of claim 1 wherein the first isolation layer is cork and the second and third isolation layers are foam.

5. The assembly of claim 1 wherein potting material further encapsulates the ultrasonic transducer in the cavity.

6. The assembly of claim 5 wherein the potting material is urethane.

7. The assembly of claim 6 wherein the first isolation layer is cork and the second and third isolation layers are neoprene.

8. The assembly of claim 1 wherein the potting layer has a thickness in a range between 1 mm to 25 mm.

9. The assembly of claim 8 wherein the potting layer has a thickness of about 3 mm.

10. The assembly of claim 1 further comprising a through-hull speed sensor assembly.

11. The assembly of claim 1 wherein the housing is adapted for mounting to the transom of a marine vessel.

12. An ultrasonic transducer assembly for generating and receiving ultrasonic vibratory forces to and from an aqueous medium, comprising:

a unitary housing for mounting to a marine vessel, including a cavity formed therein for disposing an ultrasonic transducer and an acoustic window portion integrally formed in the bottom of the housing;

an ultrasonic transducer disposed in the cavity comprising a transducer element having a first isolation layer on its sides and a second isolation layer on its top surface; and a layer of potting material formed between the bottom surface of the transducer element and the acoustic window portion of the housing, wherein the acoustic window portion has an acoustic impedance greater than that of the potting material layer and the aqueous medium.

13. The assembly of claim 12 wherein the housing is formed of plastic and the acoustic window portion has a thickness of about ¼ of the wavelength of sound traveling in plastic at an operating resonant frequency.

14. The assembly of claim 12 wherein the potting material is urethane.

15. The assembly of claim 12 wherein the first isolation layer is cork and the second isolation layer is foam.

16. The assembly of claim 12 wherein the ultrasonic transducer further includes an electrostatic shielding enclosure surrounding the top and sides of the transducer element having a third isolation layer on its outer surface.

17. The assembly of claim 16 wherein potting material further encapsulates the ultrasonic transducer in the cavity.

18. The assembly of claim 17 wherein the potting material is urethane.

19. The assembly of claim 18 wherein the first isolation layer is cork and the second and third isolation layers are neoprene.

20. The assembly of claim 12 wherein the potting layer has a thickness in a range between 1 mm to 25 mm.

21. The assembly of claim 20 wherein the potting layer has a thickness of about 3 mm.

22. The assembly of claim 12 further comprising a through-hull speed sensor assembly.

23. The assembly of claim 12 wherein the housing is adapted for mounting to the transom of a marine vessel.

24. An ultrasonic transducer assembly for generating and receiving ultrasonic vibratory forces comprising:

a unitary housing for mounting to a marine vessel, including a cavity formed therein for disposing an ultrasonic transducer and an acoustic window portion integrally formed in the bottom of the housing;

an ultrasonic transducer disposed in the cavity comprising a transducer element having a cork layer on its sides and an inner foam layer on its top surface, an electrostatic shielding enclosure surrounding the top and sides of the transducer element having an outer foam layer on its outer surface; and a layer of potting material formed between the bottom surface of the transducer element and the acoustic window portion of the housing.

25. The assembly of claim 24 wherein potting material further encapsulates the ultrasonic transducer in the cavity.

26. The assembly of claim 25 wherein the potting material is urethane.

27. The assembly of claim 26 wherein the inner and outer foam layers are neoprene.

28. The assembly of claim 24 wherein the housing is formed of plastic and the acoustic window portion has a thickness of about ¼ of the wavelength of sound traveling in plastic at an operating resonant frequency.

29. A marine instrument comprising:

a paddlewheel assembly for sensing speed;

a unitary housing for mounting to a marine vessel, including a cavity formed therein for disposing an ultrasonic transducer and an acoustic window portion integrally formed in the bottom of the housing;

an ultrasonic transducer disposed in the cavity comprising a transducer element having a first isolation layer on its sides and a second isolation layer on its top surface; and a layer of potting material formed between the bottom surface of the transducer element and the acoustic window portion of the housing, wherein the acoustic window portion has an acoustic impedance greater than that of the potting material layer.

30. The marine instrument of claim 29 wherein the ultrasonic transducer further includes an electrostatic shielding enclosure surrounding the top and sides of the transducer element having a third isolation layer on its outer surface.

31. The assembly of claim 30 wherein the first isolation layer is cork and the second and third isolation layers are neoprene.

32. The marine instrument of claim 29 wherein the housing is formed of plastic and the acoustic window portion has a thickness of about ¼ of the wavelength of sound traveling in plastic at an operating resonant frequency.

33. The assembly of claim 12 wherein the ultrasonic transducer further includes a metallic enclosure surrounding the top and sides of the transducer element having a third isolation layer on its outer surface.

34. The marine instrument of claim 29 wherein the ultrasonic transducer further includes a metallic enclosure surrounding the top and sides of the transducer element having a third isolation layer on its outer surface.

35. An ultrasonic transducer assembly for generating and receiving ultrasonic vibratory forces comprising:

a unitary housing for mounting to a marine vessel, including a cavity formed therein for disposing an ultrasonic transducer;

an ultrasonic transducer disposed in the cavity comprising a transducer element having a first isolation layer on its sides and a second isolation layer on its top surface, a metallic enclosure surrounding the top and sides of the transducer element having a third isolation layer on its outer surface; and a layer of potting material formed between the bottom surface of the transducer element and the bottom of the housing.

* * * * *